US007255670B2

(12) United States Patent
Hensley et al.

(10) Patent No.: US 7,255,670 B2
(45) Date of Patent: Aug. 14, 2007

(54) THREE PHASE DECANTER CENTRIFUGE

(75) Inventors: Gary Hensley, Kingwood, TX (US); Lee Hilpert, Livingston, TX (US)

(73) Assignee: Hutchison Hayes, L.P., Houston, TX (US)

( * ) Notice: Subject to any disclaimer, the term of this patent is extended or adjusted under 35 U.S.C. 154(b) by 254 days.

(21) Appl. No.: 10/906,597

(22) Filed: Feb. 25, 2005

(65) Prior Publication Data

US 2005/0197241 A1 Sep. 8, 2005

Related U.S. Application Data

(60) Provisional application No. 60/550,070, filed on Mar. 4, 2004.

(51) Int. Cl.
*B04B 11/08* (2006.01)
*B04B 13/00* (2006.01)
*B04B 1/20* (2006.01)

(52) U.S. Cl. ..... 494/10; 494/53; 494/57

(58) Field of Classification Search ..... 494/1, 494/10, 53, 56, 57; 210/380.1, 380.3
See application file for complete search history.

(56) References Cited

U.S. PATENT DOCUMENTS 3,279,687 A * 10/1966 Amero ..... 494/37
3,279,688 A * 10/1966 Cook ..... 494/10
3,321,131 A * 5/1967 Cook ..... 494/10
3,532,264 A * 10/1970 Amero ..... 494/6
3,580,492 A * 5/1971 Schnittger et al. ..... 494/53
3,623,656 A * 11/1971 Lavanchy ..... 494/53
4,335,846 A * 6/1982 Shapiro ..... 494/54
4,464,162 A * 8/1984 Cummings ..... 494/53
4,615,690 A * 10/1986 Ecker ..... 494/56
5,542,903 A * 8/1996 Nishida et al. ..... 494/53
5,685,819 A * 11/1997 Nishida et al. ..... 494/53
5,800,332 A * 9/1998 Hensley ..... 494/53
7,056,273 B2 * 6/2006 Ostkamp et al. ..... 494/27
2004/0185999 A1 * 9/2004 Beyer et al. ..... 494/53
2005/0197241 A1 * 9/2005 Hensley et al. ..... 494/57
2005/0227848 A1 * 10/2005 Ostkamp et al. ..... 494/53

FOREIGN PATENT DOCUMENTS

DE 2246113 * 5/1973
DE 3822983 A1 * 1/1990
DE 10336350 A1 * 3/2005
EP 640398 A2 * 3/1995
WO WO 03074185 A1 * 9/2003

* cited by examiner

*Primary Examiner*—Charles E. Cooley
(74) *Attorney, Agent, or Firm*—Law Office of Tim Cook P.C.

(57) ABSTRACT

A three-phase decanting centrifuge is provided. Solids are removed from a slurry in the centrifuge in the conventional manner, as described above. The liquid separated from the slurry moves into a fluids reservoir. Centrifugal action classifies the fluids, with lighter fluids (typically oil) radially closer to the axis of rotation of the machine, while the heavier fluids are radially farther from the axis, i.e. at the bottom of the reservoir. Lighter fluids flow out a plurality of overflow tubes. Heavier fluids flow through a plurality of ports into a heavy fluids reservoir to be skimmed out by a pair of radially actuatable skimmer tubes. The skimmer tubes are preferably automatically operated based on the light transmissivity of the lighter and heavier fluids discharged from the machine.

4 Claims, 3 Drawing Sheets

THREE PHASE DECANTER CENTRIFUGE

This application claims the benefit of U.S. Provisional Application Ser. No. 60/550,070 filed Mar. 4, 2004.

FIELD OF THE INVENTION

The present invention relates generally to the field of decanting centrifuges, and, more particularly, to centrifuge configured to separate solids from a slurry and to separate two phases of liquid which results from the solids separation.

BACKGROUND OF THE INVENTION

Three phase decanting centrifuges have been developed over the years to separate solids from a slurry and to separate liquid phases, such as for example oil and water. Such centrifuges are provided by such companies as FLottweg, Centrisys, and Alfa Laval. In a typical machine, as described by FLottweg, the slurry is fed through a fixed central pipe into a distributor located in the scroll of the centrifuge. The slurry to be treated is accelerated and passes through feed ports in the scroll to the bowl.

Separation of solids from the slurry takes place in the conical cylindrical bowl which rotates at a preset speed. The slurry rotates in the bowl at the design speed and forms concentric layers or solids and liquids around the inside of the bowl. The solids in the slurry are deposited against the bowl wall under the influence of centrifugal force.

The scroll rotates at a differential speed to that of the bowl and conveys the separated solids in the direction of the conical end of the scroll. The separated solids are then discharged through openings at the conical end of the bowl. The solids then enter a stationary solids housing and are discharged down an outlet chute.

While the liquid is being clarified (i.e. having the solids removed therefrom), it flows to the cylindrical end of the bowl and overflows adjustable weir plates which determine the depth of the pond. The clarified liquid is decanted into a fixed centrate chamber where two liquid phases with different specific gravities may be separated. The two liquids (e.g. oil and water) are separated in the liquid zone (two phase) and decanted through separate discharge systems to prevent cross-contamination. An adjustable paring disc provides a pressure discharge for the heavier (water) phase. If the density difference or the quantity of the two phases changes, the paring disc allows the interface between the two liquid phases to be optimally adjusted during operation to ensure maximum purity of the liquid phases.

Unfortunately, the paring disk must be adjusted by hand while monitoring the quality of the discharge. As the mix of solids and phases of liquids changes over time, an operator must recognize the changing quality of liquids at the discharges and adjust the paring disc accordingly. With rapidly changing slurry, the operator must remain dedicated to the machine, and is not free to perform other duties.

Thus, there remains a need for a three phase decanting centrifuge which can adapt to a changing mix or recipe of a slurry and maintain a desirable separation of liquid.

SUMMARY OF THE INVENTION

The present invention provides a three-phase decanting centrifuge for separating solids and two phases of liquid from a slurry. Solids are removed from the slurry in the centrifuge in the conventional manner, as described above.

Centrifugal action classifies the fluids, with lighter fluids (typically oil) radially closer to the axis of rotation of the machine, while the heavier fluids are radially farther from the axis, i.e. at the bottom of the bowl prior to flowing into a fluid reservoir. The lighter phase of the liquid remains within the bowl until discharged out of light phase discharge nozzles, while the heavier phase of the liquid flows into the fluid reservoir. One or more skimmer tubes dip down into the reservoir containing the heavier fluid and centrifugal action removes the heavier fluid out a second fluid discharge.

The radial position of the skimmer tube(s) is controlled from outside the machine. A set of sensors, preferably turbidity detectors, sample the first and second fluids discharges. A change in the makeup of the phases of fluids will alter the turbidity of one or both of the liquids discharged from the machine. The sensors feed signals to a computer, and the computer calculates the ideal radial position for the skimmer tube(s). A signal is sent from the computer to an actuator controller, and the actuator controller positions a control arm to rotate an actuator. The actuator is coupled by a rack and pinion gear arrangement to alter the position of the skimmer tube(s).

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF A PREFERRED EMBODIMENT

Figure 1:
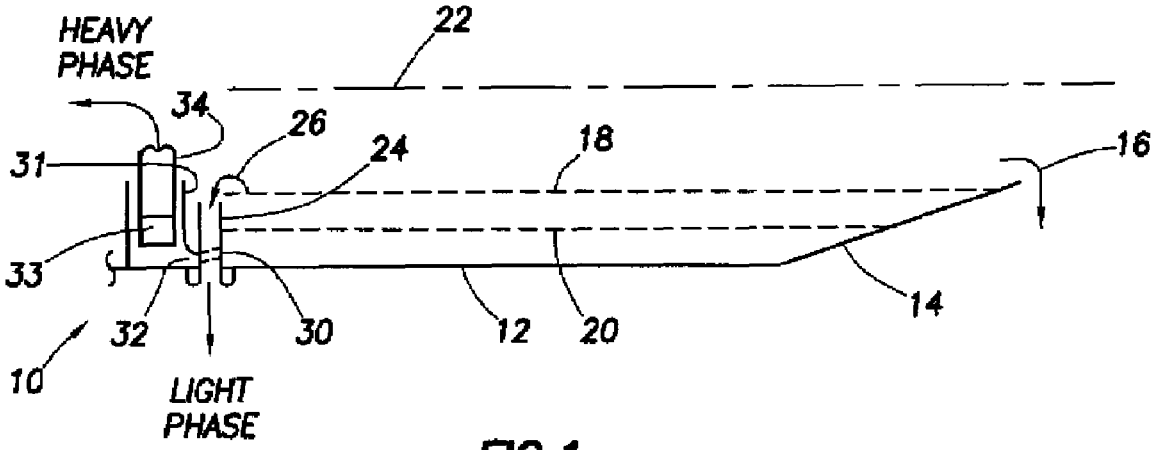
FIG. 1 is a side elevation view of a conceptual schematic of the liquid phase separator of this invention.

Focusing first on FIG. 1, a liquids phase separator 10 is illustrated. The separator 10 comprises a structural portion of a much larger decanting centrifuge, a portion of which is illustrated in FIG. 1. The decanting centrifuge is shown in FIG. 1 without the conventional screw conveyor or scroll in order to illustrate the three-phase separator of the present invention.

The liquids phase separator 10 includes a rapidly spinning bowl comprising a cylindrical portion 12 and a conical portion 14. Solids, separated from a slurry introduced to the centrifuge, are scrolled up the conical portion 14 of the bowl where they are discharged through a solids discharge as shown by an arrow 16. The liquid remainder of the slurry is stratified into a lighter layer 18 (typically oil or oil based component) and a heavier layer 20 (typically water). Together, the two liquids layers may be referred to as the "pond". The entire apparatus rotates about an axis 22 in a manner well known in the art, thus the lighter phase liquid is stratified closer to the axis 22 while the heavier phase is flung out farther away from the axis by action of the centrifuge.

The lighter phase of the fluid rises in the pond (toward the axis 22) until it exceeds the level of the top of the opening of a discharge nozzle 24 where it overflows the nozzle as shown by an arrow 26. Note also the positioning of the plurality of discharge nozzles 24 in FIG. 2. The lighter phase discharges through one of a plurality of discharge ports 28, as shown in FIGS. 2 and 3.

Figure 3:
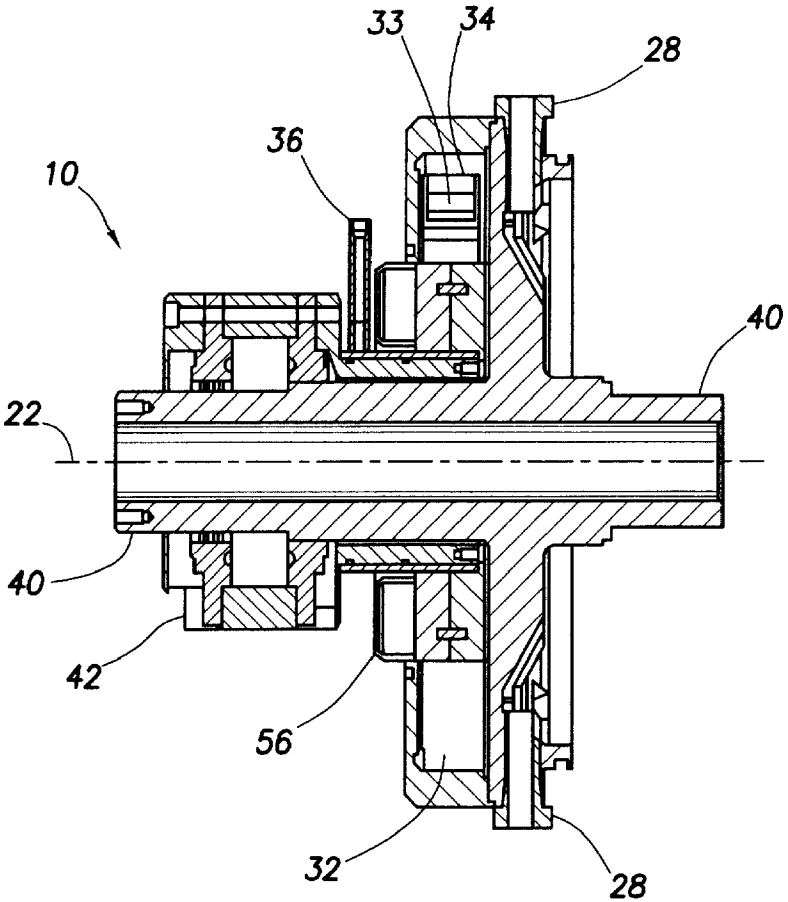
FIG. 3 is a side section view of the liquid phase separator of this invention taken along section lines 3-3 of FIG. 2.
Figure 2:
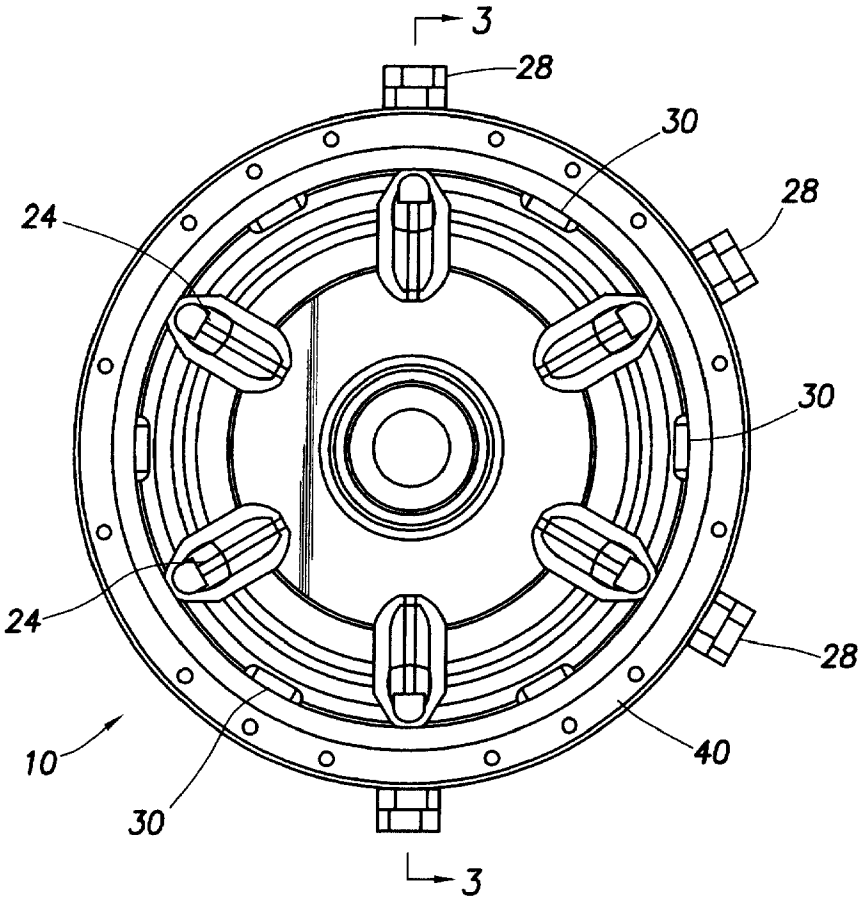
FIG. 2 is a side elevation view of a light phase discharge nozzle assembly of this invention.

Referring now to FIGS. 1 through 3, the heavier phase of the fluid flows through a plurality of ports 30 into a heavy phase reservoir 32, which is isolated from the pond by a divider plate 31. The heavy phase reservoir turns at bowl speed and encloses a pair of stationary skimmer tubes 34, shown and described below in greater detail. The radial position of the skimmer tubes is automatically and remotely adjusted to accommodate the quantity and mix of light and heavy phases of the fluid being processed, a feature of the invention. The radial position of the skimmer tubes is altered in operation by an actuator 36, shown and described in respect of FIGS. 4 through 7 below in greater detail. As shown in FIGS. 1 and 3, each skimmer tube 34 defines an opening 33 into which heavy phase liquid flows under the influence of the rotation of the bowl of the centrifuge.

Thus, it can be appreciated that lowering the skimmer tubes into the heavy phase reservoir 32 (i.e. extending the skimmer tubes radially outwardly from the axis 22) pulls more of the heavy phase fluid from the reservoir. Because heavy phase fluid flows through the ports 30, this action lowers the level 20 in the pond. In this way, the action of the centrifuge is adjusted to either produce less light phase fluid with the heavy phase (i.e. less oil in the water that is discharged) or less heavy phase fluid with the light phase i.e. less water in the oil that is discharged).

FIG. 3 depicts other structural elements of the preferred embodiment of the invention. The largest and heaviest element of the structure is a liquids hub 40 which rotates at bowl speed about the axis 22. The liquids hub 40 is supported by a pillow block 42 with surrounding covers and other elements. Through these additional elements, the actuator 36 is supported for control of the stationary skimmer tubes and elements coupled thereto. By "stationary" is meant that the skimmer tubes do not spin at bowl speed; the skimmer tubes do, however, move radially to skim more or less of the heavier phase of liquid, as described above.

Figure 4:
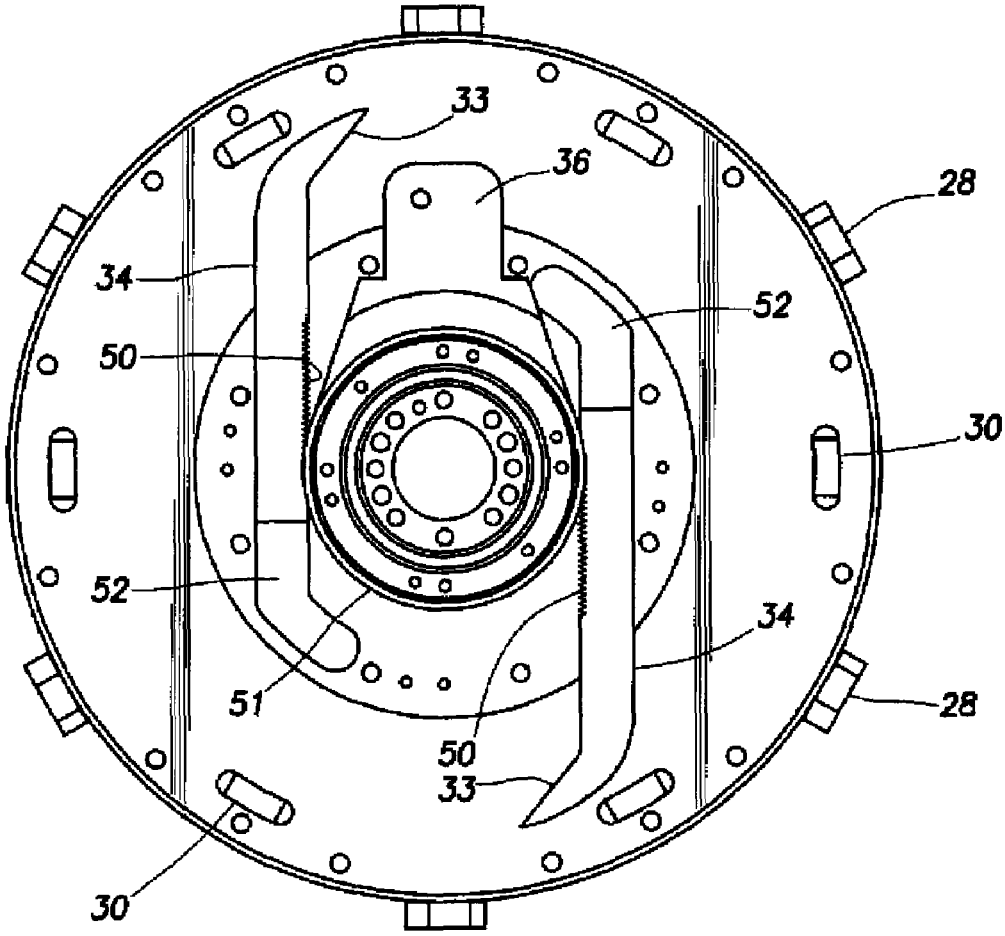
FIG. 4 is an end view of a liquid phase separator with covers removed to show the internal workings of the mechanism.

Referring now to FIGS. 4 through 7, a series of images of the present invention are depicted at various stages of assembly. In FIG. 4, the actuator 36 is mechanically coupled to the skimmer tubes 34 by a rack and pinion arrangement, including rack 50 and a pinion gear 51. The pinion gear is an integral part of the actuator 36 to engage the rack 50. Rotation of the actuator 36 thus moves the skimmer tubes 34 vertically up and down, as seen in FIG. 4, thereby moving the openings 33 of the skimmer tubes deeper or shallower into the heavy phase liquid as described above.

Figure 5:
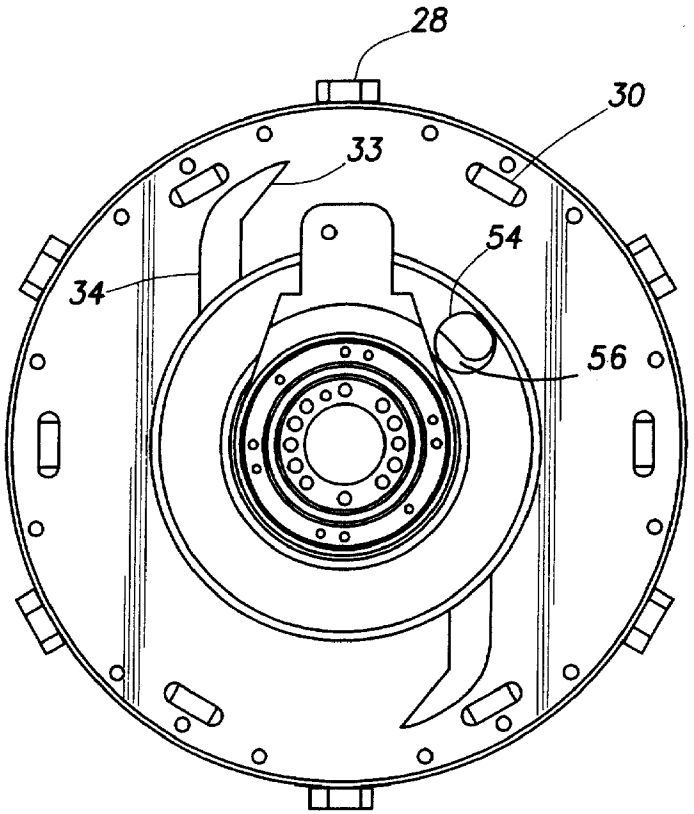
FIG. 5 is an end view, like that of FIG. 4, with the covers in place.

The heavy phase liquid enters the hollow skimmer tubes at the point closest to the periphery of the bowl, and moves by inertia to a set of flow channels 52. Referring now to FIG. 5, the heavy phase fluid then travels through a flow channel 56 and then out through an orifice 54 for discharge from the machine. That completes the description of the separation and discharge of the heavier phase fluid from this three-phase separator.

The lighter phase fluid is discharged from the machine at the discharge ports 28 and the heavy phase fluid is discharged from the heavy phase flow channel 56. Each of the discharges is then sampled with sensors to determine the content of the fluid at the specific discharge. Since water has a different light transmissivity than oil, the turbidity of the fluid at the sensor provides a direct correlation in respect of the oil/water content of the fluid.

Figure 6:
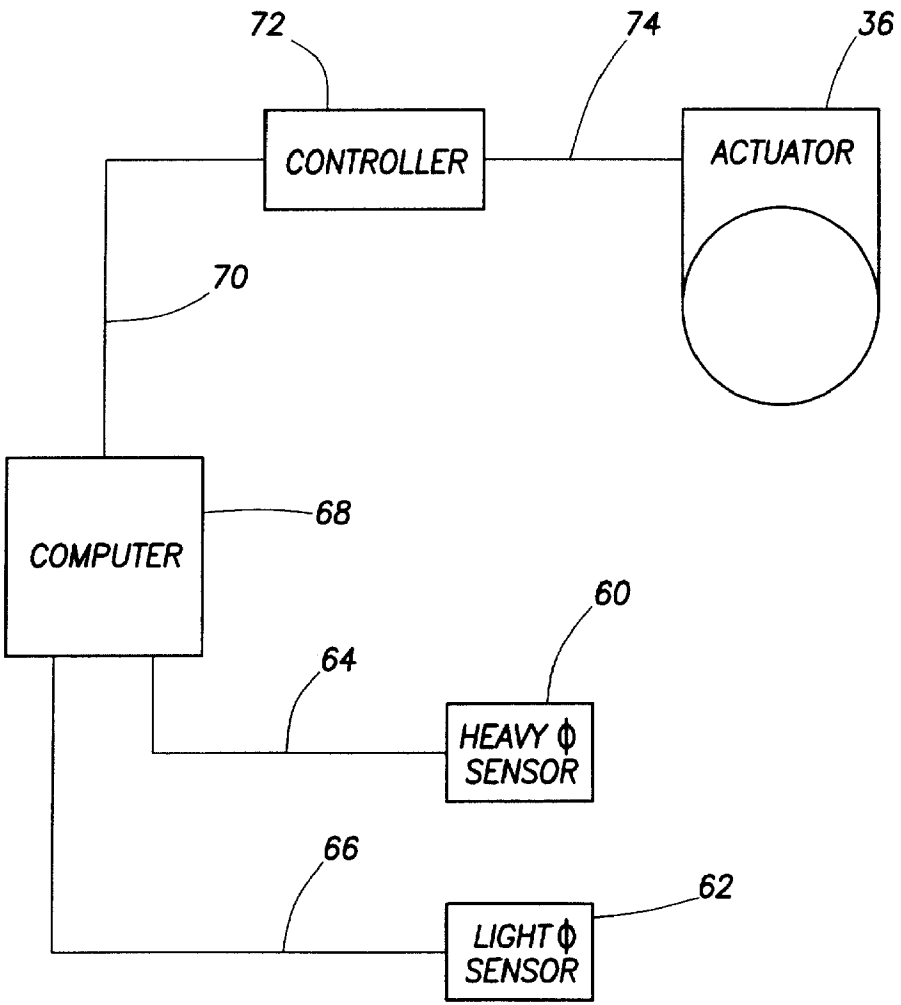
FIG. 6 is a schematic diagram of a control circuit for control of the present invention.

FIG. 6 illustrates the automatic control portion of the invention, including a heavy phase sensor 60 and a light phase sensor 62. The heavy phase sensor provides a signal over a signal line 64 and the light phase sensor provides a signal over a signal line 66 to a computer 68. The computer maintains a history of the signals from the sensor, and includes a comparison table to indicate the mix or oil and fluid from each of the sensors. Any change from the history maintained by the computer is immediately sensed, a correction calculation is performed, and a control signal is sent by the computer 68 of a signal line 70 to an actuator controller 72. The actuator controller 72 is preferably an electric drive device, although other appropriate mechanisms may be used. The actuator controller 72 drives a linkage 74 which is mechanically coupled to the actuator 36, rotating the actuator and thereby moving the skimmer tubes up or down, depending on the correction signal developed by the computer.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

What is claimed is:

1. A three phase centrifuge having a bowl, the centrifuge comprising:

a. means to remove solids from a slurry to develop a fluid having a heavy phase liquid and a light phase liquid;

b. a fluid phase separator having a remotely controlled actuator to control the separation of light phase liquid from heavy phase liquid; and c. control means to sense the light phase content and the heavy phase content to control the relative content of the two phases;

d. a pond inside the bowl defined by a conical section and a cylindrical section of a centrifuge bowl and wherein the heavy phase liquid and the light phase liquid as separated into layers in the pond, the heavy phase liquid and the light phase liquid together comprising a depth of the pond;

e. a heavy phase liquid reservoir;

f. a plurality of ports from the pond into the heavy phase liquid reservoir;

g. a hollow skimmer tube extending into the heavy phase liquid reservoir to draw heavy phase liquid from the reservoir, wherein the skimmer tube comprises a pair of simultaneously actuatable skimmer tubes; and h. a rack and pinion arrangement coupling the pair of skimmer tubes to the remotely controlled actuator.

2. The centrifuge of claim 1, further comprising a plurality of light phase nozzles extending through the pond and determining the depth of the pond.

3. The centrifuge of claim 1, further comprising:

a heavy phase sensor to sense the light transmissivity of the heavy phase liquid separated from the slurry and to develop a heavy phase signal as a function of the sensed transmissivity; and a light phase sensor to sense the light transmissivity of the light phase liquid separated from the slurry and to develop a light phase signal as a function of the sensed transmissivity.

4. The centrifuge of claim 3, further comprising a computer to receive the heavy phase signal and the light phase signal and to control the remotely controlled actuator in response to these signals.

* * * * *